US010497510B2

(12) United States Patent
Ishida

(10) Patent No.: US 10,497,510 B2
(45) Date of Patent: Dec. 3, 2019

(54) ELECTRONIC COMPONENT

(71) Applicant: Murata Manufacturing Co., Ltd., Kyoto (JP)

(72) Inventor: Kosuke Ishida, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 331 days.

(21) Appl. No.: 15/597,208

(22) Filed: May 17, 2017

(65) Prior Publication Data

US 2017/0352475 A1 Dec. 7, 2017

(30) Foreign Application Priority Data

Jun. 1, 2016 (JP) ..... 2016-110245

(51) Int. Cl.

| | |
|---|---|
| ***H01F 27/40*** | (2006.01) |
| ***H01F 27/255*** | (2006.01) |
| ***H01F 27/28*** | (2006.01) |
| ***H01F 27/29*** | (2006.01) |

(52) U.S. Cl.

CPC ..... *H01F 27/40* (2013.01); *H01F 27/255* (2013.01); *H01F 27/2804* (2013.01); *H01F 27/29* (2013.01); *H01F 2027/2809* (2013.01)

(58) Field of Classification Search

CPC ..... H01F 27/40; H01F 17/0013; H01F 2017/0026

See application file for complete search history.

(56) References Cited

U.S. PATENT DOCUMENTS

2007/0139151 A1* 6/2007 Nussbaum ..... H01F 17/0013 336/200
2013/0223033 A1* 8/2013 Mano ..... H01F 17/0013 361/763

FOREIGN PATENT DOCUMENTS

| | | | |
|---|---|---|---|
| CN | 102598165 | A | 7/2012 |
| CN | 104658741 | A | 5/2015 |
| JP | H05308021 | A | 11/1993 |
| JP | 2005-086676 | A | 3/2005 |
| JP | 2005340586 | A | 12/2005 |
| JP | 2011004324 | A | 1/2011 |
| JP | 2011-091097 | A | 5/2011 |

(Continued)

OTHER PUBLICATIONS

An Office Action; "Notification of Reasons for Refusal," Mailed by the Japanese Patent Office dated Jan. 8, 2019, which corresponds to Japanese Patent Application No. 2016-110245 and is related to U.S. Appl. No. 15/597,208; with English language translation.

(Continued)

*Primary Examiner* — Scott Bauer
(74) *Attorney, Agent, or Firm* — Studebaker & Brackett PC

(57) ABSTRACT

An electronic component having an electric element including a coil, a magnetic layer covering at least a portion of the electric element, a plurality of external terminals electrically connected to the electric element and embedded in the magnetic layer to be partially exposed from one surface of the magnetic layer, and a nonmagnetic layer embedded in the magnetic layer. The plurality of external terminals include at least one or more first external terminals. The first external terminals are surrounded by the nonmagnetic layer when viewed from the one surface side of the magnetic layer.

8 Claims, 7 Drawing Sheets

(56) References Cited

FOREIGN PATENT DOCUMENTS

| | | | |
|---|---|---|---|
| JP | 2013-098259 | A | 5/2013 |
| WO | 2011058945 | A1 | 5/2011 |

OTHER PUBLICATIONS

An Office Action mailed by the Chinese Patent Office dated Mar. 8, 2019, which corresponds to Chinese Patent Application No. 201710311666.2 and is related to U.S. Appl. No. 15/597,208 with English language translation.

An Office Action; "Notification of Reasons for Refusal," Mailed by the Japanese Patent Office dated Jul. 23, 2019, which corresponds to Japanese Patent Application No. 2016-110245 and is related to U.S. Appl. No. 15/597,208; with English language translation.

* cited by examiner

ELECTRONIC COMPONENT

CROSS REFERENCE TO RELATED APPLICATIONS

This application claims benefit of priority to Japanese Patent Application 2016-110245 filed Jun. 1, 2016, the entire content of which is incorporated herein by reference.

TECHNICAL FIELD

The present disclosure relates to an electronic component.

BACKGROUND

Conventional electronic components include an electronic component described in JP 2013-98259 A. The electronic component includes an electric element including a coil, a magnetic layer covering a portion of the electric element, and a plurality of external terminals electrically connected to the electric element and embedded to be partially exposed from the magnetic layer.

SUMMARY

Problem to be Solved by the Disclosure

It was found out that the following problem exists when the conventional coil component as described above is actually used. Since the magnetic layer is close to the external terminals, a magnetic loss occurs around the external terminals at the time of energization. Depending on a configuration of the electronic component, it is desired to reduce such a magnetic loss at some external terminals. For example, it is preferable to reduce the magnetic loss at the external terminals connected to a capacitor in an electronic component so as to reduce a parasitic inductance. Even in the case of the external terminals connected to the coil, it may be desired to reduce the magnetic loss occurring around the external terminals so as to adjust an inductance.

Therefore, a problem to be solved by the present disclosure is to provide an electronic component with a reduced magnetic loss occurring around the external terminals.

Solutions to the Problems

To solve the problem, an aspect of the present disclosure provides an electronic component comprising:

an electric element including a coil;

a magnetic layer covering at least a portion of the electric element;

a plurality of external terminals electrically connected to the electric element and embedded in the magnetic layer to be partially exposed from one surface of the magnetic layer; and a nonmagnetic layer embedded in the magnetic layer, the plurality of external terminals including at least one or more first external terminals, the first external terminals being surrounded by the nonmagnetic layer when viewed from the one surface side of the magnetic layer.

According to the electronic component, a magnetic loss occurring around the first external terminals can be reduced.

In an embodiment of the electronic component, the nonmagnetic layer is in contact with the first external terminals.

According to the embodiment, the magnetic loss occurring around the first external terminals can further be reduced.

In an embodiment of the electronic component, the nonmagnetic layer surrounds the entire outer circumference of the first external terminal when viewed from the one surface side of the magnetic layer.

According to the embodiment, the magnetic loss occurring around the first external terminals can further be reduced.

In an embodiment of the electronic component, the nonmagnetic layer is embedded to penetrate the magnetic layer from the one surface side to the other side opposite thereto.

According to the embodiment, the magnetic loss occurring around the first external terminals can further be reduced.

In an embodiment of the electronic component, the electric element includes a capacitor, and the first external terminals are connected to the capacitor.

According to the embodiment, the parasitic inductance of the capacitor can be reduced and the capacitor characteristics can be improved.

In an embodiment of the electronic component, the first external terminals connected to the capacitor are connected to ground.

According to the embodiment, the magnetic loss due to an impedance generated in the path between the capacitor and the ground can be reduced.

In an embodiment of the electronic component, the electronic component further comprises an insulator that is made up of a plurality of insulating layers laminated on the other surface on the side opposite to the one surface of the magnetic layer and that has the electric element embedded therein, and the coil includes conductor layers wound on the insulating layers.

According to the embodiment, the conductor layer enables reductions in size and height.

In an embodiment of the electronic component, when viewed from the one surface side of the magnetic layer, two of the conductor layers are wound on the same one of the insulating layers, and the nonmagnetic layer is disposed to divide the two conductor layers from each other.

According to the embodiment, a magnetic path can be divided between two coils in the magnetic layer and the isolation between the coils can be improved.

Effect of the Disclosure

According to the electronic component of the present disclosure, the magnetic loss occurring around the first external terminals can be reduced.

DETAILED DESCRIPTION

The present disclosure will now be described in detail with reference to shown embodiments.

(First Embodiment)

Figure 1:
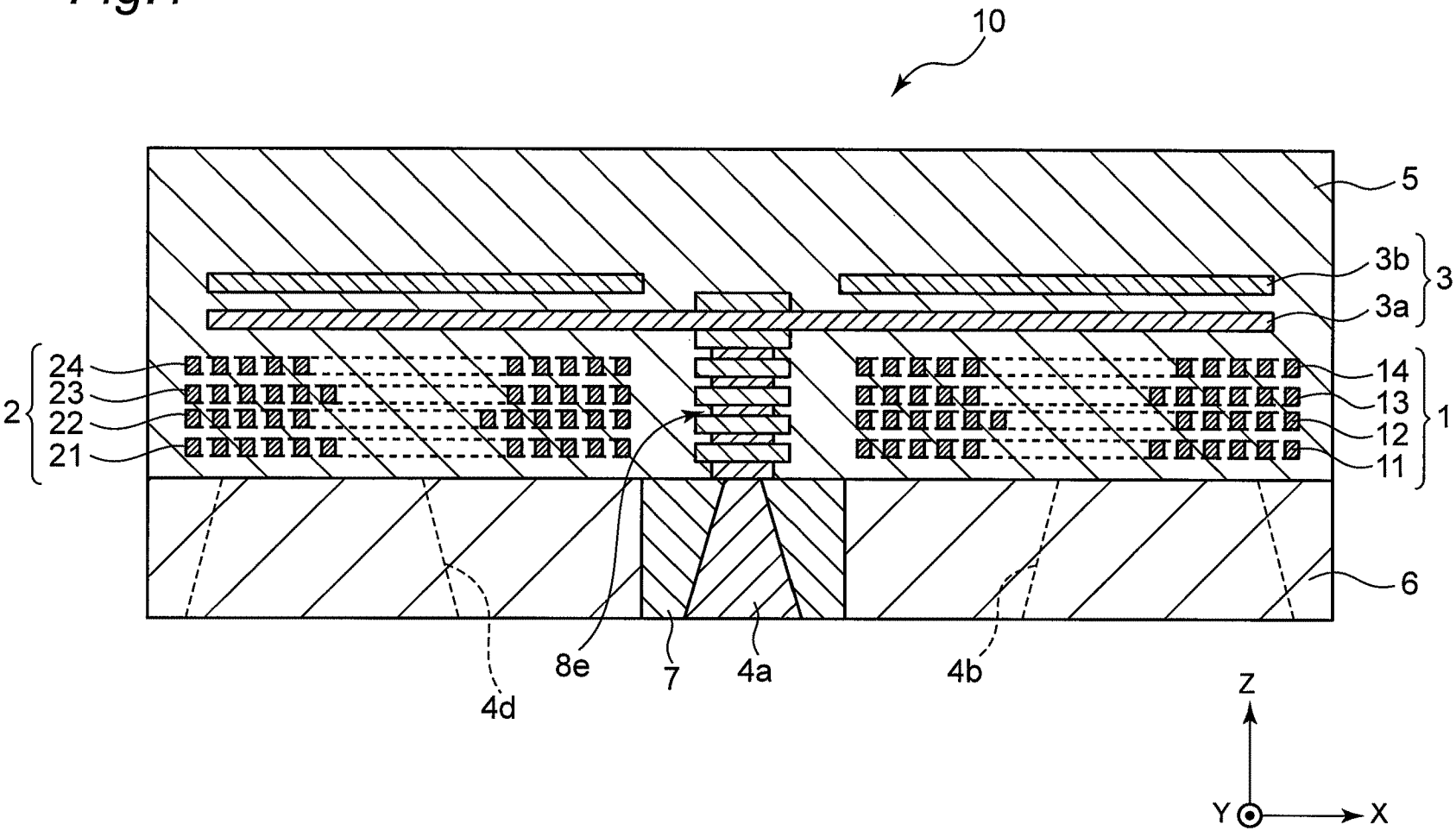
FIG. 1 is a cross-sectional view of a first embodiment of an electronic component.
Figure 2:
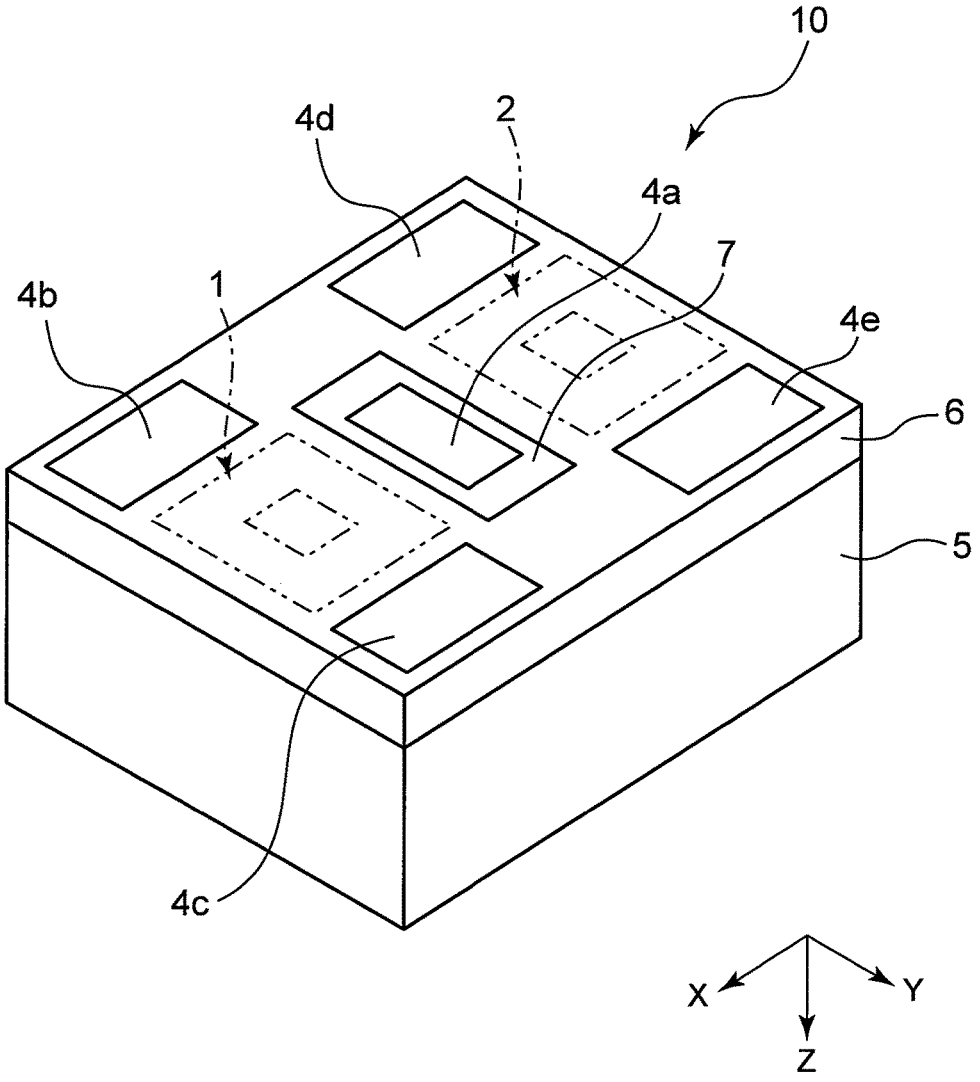
FIG. 2 is a perspective view of the electronic component viewed from the bottom surface side.
Figure 3:
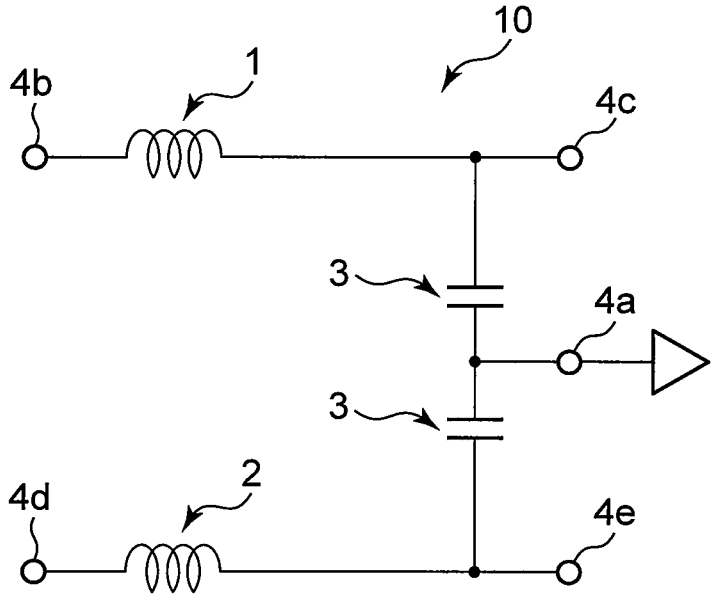
FIG. 3 is an equivalent circuit diagram of the electronic component.
Figure 4A:
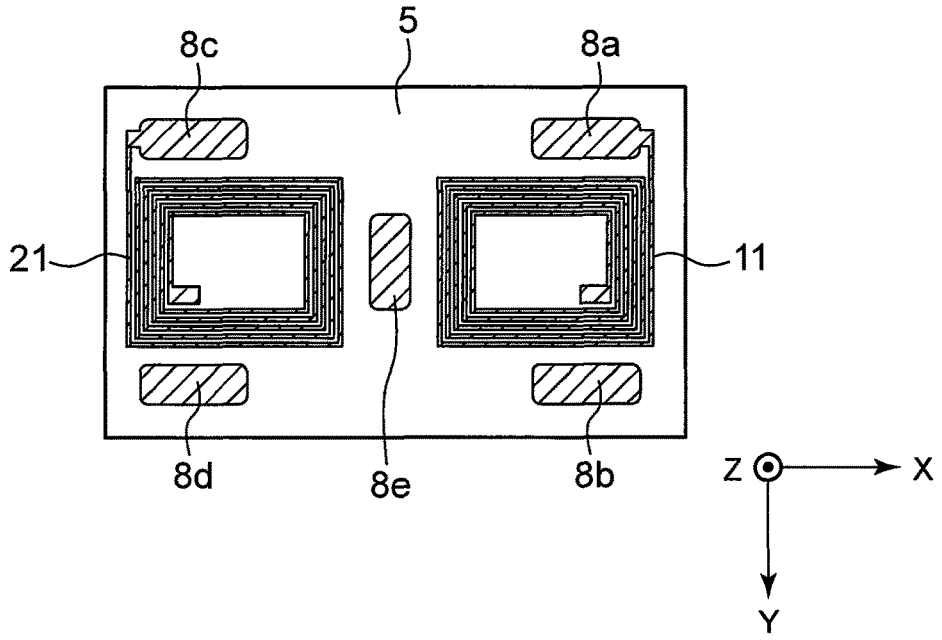
FIG. 4A is a plane view of a first spiral wiring of a first coil and a first spiral wiring of a second coil.
Figure 4B:
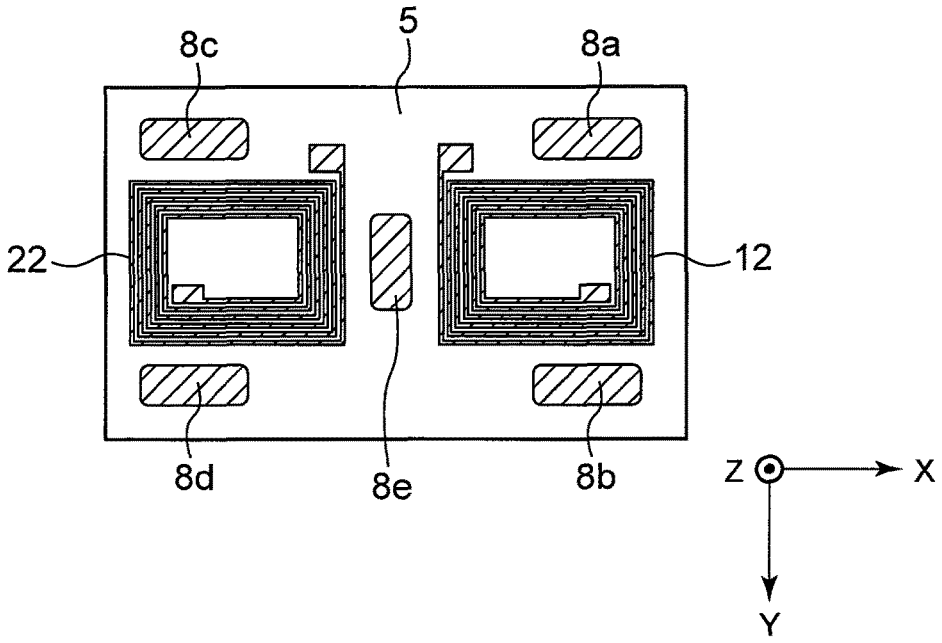
FIG. 4B is a plane view of a second spiral wiring of the first coil and a second spiral wiring of the second coil.
Figure 4C:
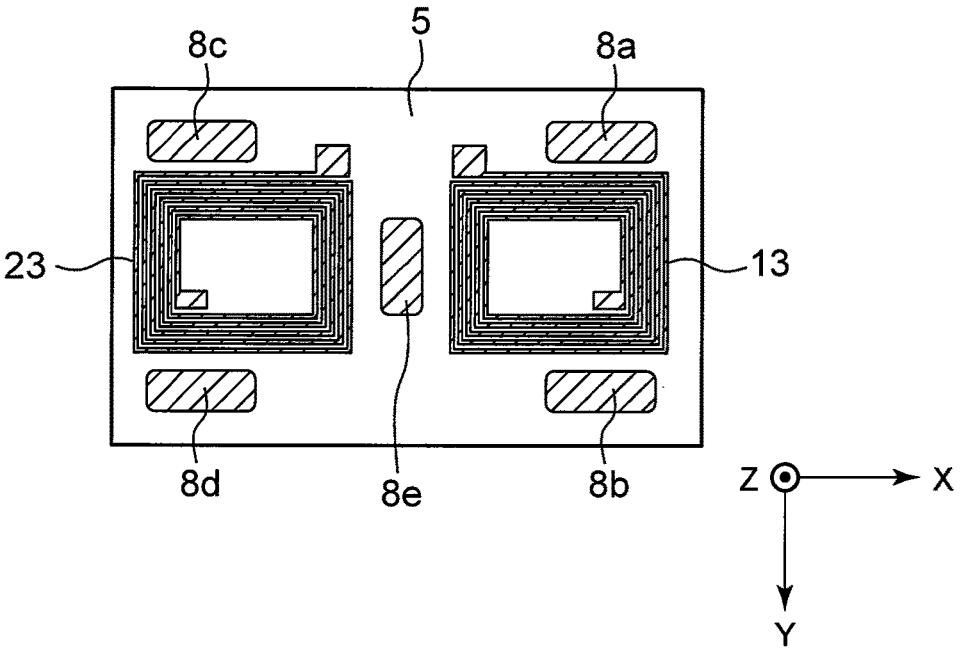
FIG. 4C is a plane view of a third spiral wiring of the first coil and a third spiral wiring of the second coil.
Figure 4D:
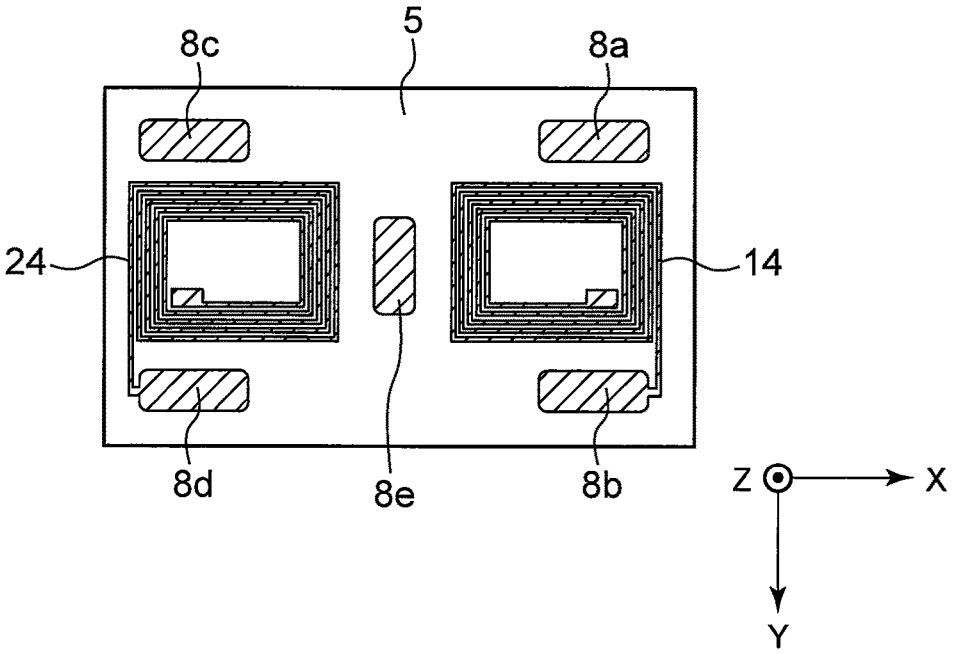
FIG. 4D is a plane view of a fourth spiral wiring of the first coil and a fourth spiral wiring of the second coil.
Figure 5A:
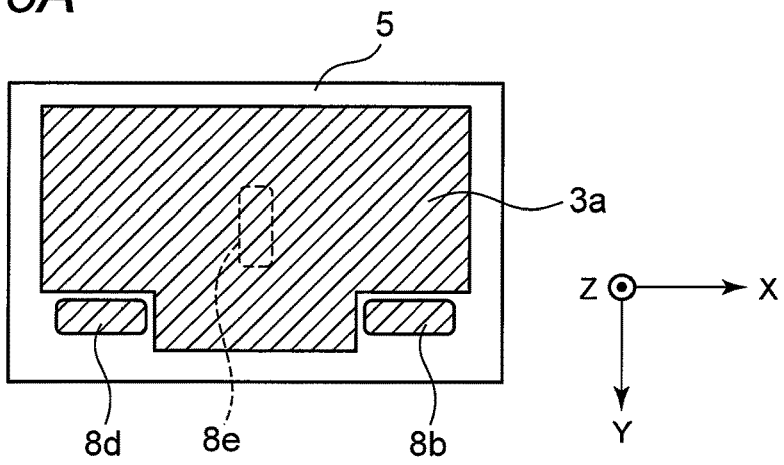
FIG. 5A is a plane view of a first electrode plate of a capacitor.
Figure 5B:
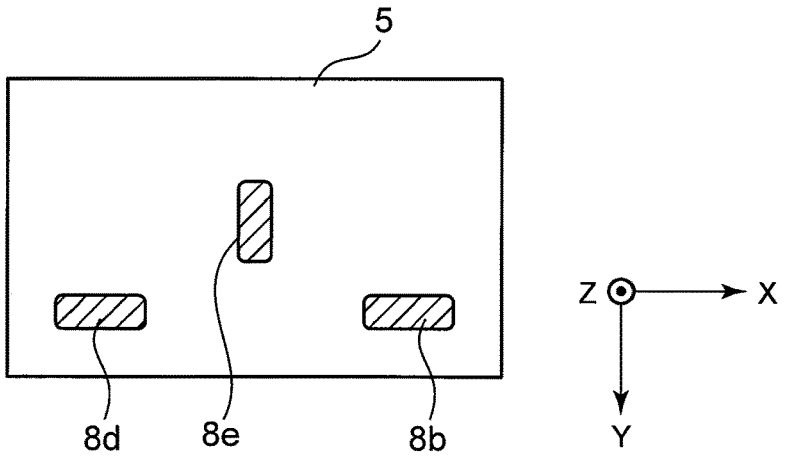
FIG. 5B is a plane view between the first electrode plate and a second electrode plate of the capacitor.
Figure 5C:
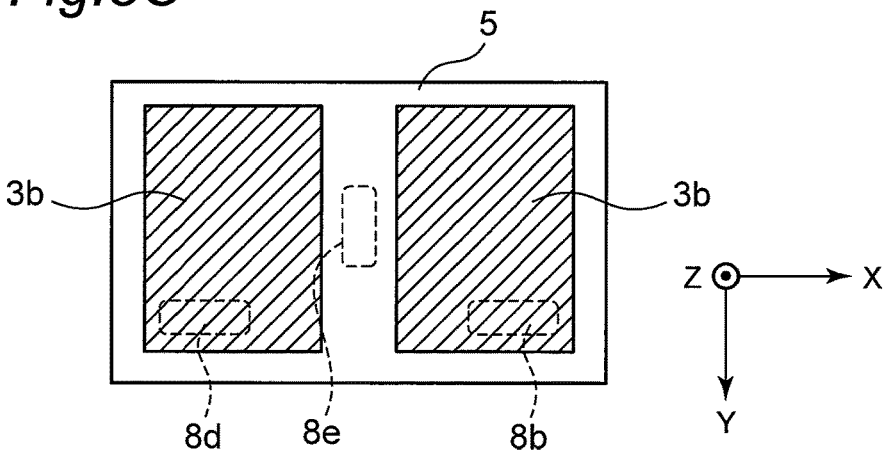
FIG. 5C is a plane view of the second electrode plate of the capacitor.

FIG. 1 is a cross-sectional view of a first embodiment of an electronic component. FIG. 2 is a perspective view of the electronic component viewed from a bottom surface. FIG. 3 is an equivalent circuit diagram of the electronic component As shown in FIGS. 1, 2, and 3, an electronic component 10 is an LC composite type electronic component including a first coil 1 and a second coil 2 as well as a capacitor 3. The electronic component 10 is mounted on an electronic device such as a personal computer, a DVD player, a digital camera, a TV, a portable telephone, and automotive electronics, for example. The electronic component 10 is used as an LC filter such as a low-pass filter, a high-pass filter, a band-pass filter, and a trap filter, for example.

The electronic component 10 has an insulator 5 in which the first and second coils 1, 2 and the capacitor 3 are embedded, and a magnetic layer 6 provided on one surface of the insulator 5. The magnetic layer 6 partially covers the first and second coils 1, 2 and therefore can ensure an inductance (L-value).

The surface of the magnetic layer 6 on the side opposite to the first and second coils 1, 2 is a mounting surface to be mounted on a mounting board. A lamination direction of the magnetic layer 6 and the insulator 5 is defined as a Z direction, and the mounting surface of the magnetic layer 6 is defined as the bottom surface (lower surface). The electronic component 10 is formed into a rectangular parallelepiped and, in a plane orthogonal to the Z direction, one side direction is defined as an X direction and the other side direction is defined as a Y direction.

A first external terminal 4*a*, a second external terminal 4*b*, a third external terminal 4*c*, a fourth external terminal 4*d*, and a fifth external terminal 4*e* are embedded in one surface of the magnetic layer 6. Portions of the first to fifth external terminals 4*a* to 4*e* are exposed from one surface of the magnetic layer 6. The exposed portions of the first to fifth external terminals 4*a* to 4*e* are connected to electrodes of the mounting board. In this embodiment, the one surface of the magnetic layer 6 corresponds to the bottom surface on the side opposite to the first and second coils 1, 2. It is noted that the one surface of the magnetic layer 6 may be a surface other than the bottom surface.

When viewed in the Z direction, the first external terminal 4*a* is disposed at the center of the rectangular bottom surface of the magnetic layer 6 and the second to fifth external terminals 4*b* to 4*e* are arranged at the four corners of the rectangular bottom surface of the magnetic layer 6.

The first coil 1 and the second coil 2 are arranged in parallel in the X direction when viewed from the bottom surface (one surface) side of the magnetic layer 6, i.e., when viewed in the Z direction. The capacitor 3 is disposed in the Z direction (on the upper side) of the first and second coils 1, 2.

When viewed in the Z direction, the second external terminal 4*b* and the third external terminal 4*c* are disposed on both sides of the first coil 1 in the Y direction. The fourth external terminal 4*d* and the fifth external terminal 4*e* are disposed on both sides of the second coil 2 in the Y direction. The first external terminal 4*a* is disposed between the first coil 1 and the second coil 2. In FIG. 2, the positions of the first coil 1 and the second coil 2 viewed from above are indicated by dashed-two dotted lines.

One end of the first coil 1 is connected to the second external terminal 4*b*, and the other end of the first coil 1 is connected to the third external terminal 4*c*. For example, the second external terminal 4*b* acts as an input terminal to the first coil 1 and the third external terminal 4*c* acts as an output terminal from the first coil 1.

One end of the second coil 2 is connected to the fourth external terminal 4*d* and the other end of the second coil 2 is connected to the fifth external terminal 4*e*. For example, the fourth external terminal 4*d* acts as an input terminal to the second coil 2 and the fifth external terminal 4*e* acts as an output terminal from the second coil 2.

As shown in FIG. 3, the other end of the first coil 1 and the other end of the second coil 2 are also connected to one end of the capacitor 3. The other end of the capacitor 3 is connected to the first external terminal 4*a*. The first external terminal 4*a* is connected to the ground. The first external terminal 4*a* is connected between the capacitor 3 and the ground.

As shown in FIG. 2, when viewed from the bottom surface side of the magnetic layer 6, a nonmagnetic layer 7 is embedded in the magnetic layer 6 to surround the entire outer circumference of the first external terminal 4*a*. The nonmagnetic layer 7 is in contact with the first external terminal 4*a* and is embedded to penetrate the magnetic layer 6 from the one surface side to the other surface side opposite thereto. When viewed from the bottom surface side of the magnetic layer 6, the nonmagnetic layer 7 may surround at least a portion of the circumference of the first external terminal 4*a* and the nonmagnetic layer 7 may be separated from the first external terminal 4*a* without being in contact.

According to the electronic component 10, the first external terminal 4*a* is embedded to be partially exposed from one surface (bottom surface) of the magnetic layer 6, and the nonmagnetic layer 7 is embedded in the magnetic layer 6 to surround the circumference of the first external terminal 4*a* when viewed from the one surface side of the magnetic layer 6. As a result, since the nonmagnetic layer 7 with a low magnetic loss is disposed around the first external terminal 4*a*, the magnetic fluxes passing through the magnetic layer 6 decrease, so that the magnetic loss occurring around the first external terminal 4*a* can be reduced.

Since the nonmagnetic layer 7 is in contact with the first external terminal 4*a*, the magnetic loss occurring around the first external terminal 4*a* can further be reduced.

Since the nonmagnetic layer 7 surrounds the entire outer circumference of the first external terminal 4*a*, the magnetic loss occurring around the first external terminal 4*a* can further be reduced. Since the nonmagnetic layer 7 is embedded to penetrate the magnetic layer 6 from the one surface side to the other surface side opposite thereto, the magnetic loss occurring around the first external terminal 4*a* can further be reduced.

Since the first external terminal 4*a* is connected to the capacitor 3, the parasitic inductance of the capacitor 3 can be reduced and the capacitor characteristics can be improved.

Since the first external terminal 4*a* is connected to the ground, the magnetic loss due to an impedance generated in the path between the capacitor 3 and the ground can be reduced.

The configuration of the electronic component 10 will hereinafter be described in detail.

As shown in FIGS. 1 and 4A to 4D, the first coil 1 includes a first spiral wiring 11, a second spiral wiring 12, a third spiral wiring 13, and a fourth spiral wiring 14 laminated in order from a lower layer to an upper layer. The insulator 5 is made up of a plurality of insulating layers. The first to fourth spiral wirings 11 to 14 are conductor layers wound on the insulating layers of the insulator 5.

An outer circumferential end of the first spiral wiring 11 is connected to a first terminal 8*a*. The first spiral wiring 11 swirls clockwise from the outer circumferential end to an inner circumferential end. The inner circumferential end of the first spiral wiring 11 is connected through a via conductor to an inner circumferential end of the second spiral wiring 12. The second spiral wiring 12 swirls clockwise from the inner circumferential end to an outer circumferential end. The outer circumferential end of the second spiral wiring 12 is connected through a via conductor to an outer circumferential end of the third spiral wiring 13. The third spiral wiring 13 swirls clockwise from the outer circumferential end to an inner circumferential end. The inner circumferential end of the third spiral wiring 13 is connected through a via conductor to an inner circumferential end of the fourth spiral wiring 14. The fourth spiral wiring 14 swirls clockwise from the inner circumferential end to an outer circumferential end. The outer circumferential end of the fourth spiral wiring 14 is connected through a via conductor to a second terminal 8*b*.

The second coil 2 includes a first spiral wiring 21, a second spiral wiring 22, a third spiral wiring 23, and a fourth spiral wiring 24 laminated in order from a lower layer to an upper layer. The first to fourth spiral wirings 21 to 24 are conductor layers wound on the insulating layers of the insulator 5.

An outer circumferential end of the first spiral wiring 21 is connected to a third terminal 8*c*. The first spiral wiring 21 swirls counterclockwise from the outer circumferential end to an inner circumferential end. The inner circumferential end of the first spiral wiring 21 is connected through a via conductor to an inner circumferential end of the second spiral wiring 22. The second spiral wiring 12 swirls counterclockwise from the inner circumferential end to an outer circumferential end. The outer circumferential end of the second spiral wiring 22 is connected through a via conductor to an outer circumferential end of the third spiral wiring 23. The third spiral wiring 23 swirls counterclockwise from the outer circumferential end to an inner circumferential end. The inner circumferential end of the third spiral wiring 23 is connected through a via conductor to an inner circumferential end of the fourth spiral wiring 24. The fourth spiral wiring 24 swirls counterclockwise from the inner circumferential end to an outer circumferential end. The outer circumferential end of the fourth spiral wiring 24 is connected to a fourth terminal 8*d*.

The first to fourth spiral wirings 11 to 14 of the first coil 1 are concentrically arranged. The first to fourth spiral wirings 21 to 24 of the second coil 2 are concentrically arranged. The axis of the first coil 1 and the axis of the second coil 2 are orthogonal to the one surface (bottom surface) of the magnetic layer 6. The axis of the first coil 1 and the axis of the second coil 2 are arranged in parallel.

As shown in FIGS. 1 and 5A to 5C, the capacitor 3 includes a first electrode plate 3*a* and a second electrode plate 3*b* laminated in order from a lower layer to an upper layer. The insulating layers of the insulator 5 and the first and second electrode plates 3*a*, 3*b* are alternately laminated. The second electrode plate 3*b* is in the form of two plates respectively connected to the second terminal 8*b* and the fourth terminal 8*d*. The first electrode plate 3*a* is connected to a fifth terminal 8*e*.

The first to fifth terminals 8*a* to 8*e* are each extended in the lamination direction and embedded in the insulator 5. When viewed in the Z direction, the first terminal 8*a* is overlapped with the second external terminal 4*b* and connected to the second external terminal 4*b*. The second terminal 8*b* is overlapped with the third external terminal 4*c* and connected to the third external terminal 4*c*. The third terminal 8*c* is overlapped with the fourth external terminal 4*d* and connected to the fourth external terminal 4*d*. The fourth terminal 8*d* is overlapped with the fifth external terminal 4*e* and connected to the fifth external terminal 4*e*. The fifth terminal 8*e* is overlapped with the first external terminal 4*a* and connected to the first external terminal 4*a*.

The first and second coils 1, 2, the capacitor 3, the first to fifth terminals 8*a* to 8*e*, and the first to fifth external terminals 4*a* to 4*e* are made of a conductive material such as Ag, Ag—Pd, Cu, and Ni, for example. The first and second coils 1, 2, the capacitor 3, the first to fifth terminals 8*a* to 8*e*, and the first to fifth external terminals 4*a* to 4*e* are formed by patterning a metal layer into a predetermined shape, for example. A method of forming the metal layer can be achieved by using coating, plating, a thin-film method, etc., and a patterning method of the metal layer can be achieved by using an additive method, a subtractive method, etc. using a screen mask, a photomask, etc.

The insulator 5 has insulation properties and is made of a resin material such as polyimide, a glass material, or glass ceramics, for example. The nonmagnetic layer 7 has nonmagnetic properties and is made of a resin material such as polyimide, a glass material, or glass ceramics, for example.

The magnetic layer 6 has magnetic properties and is made of a magnetic material such as ferrite, for example. Preferably, the magnetic layer 6 contains metal magnetic powder and the characteristics (such as an inductance value and direct current superposition characteristics) of the electronic component 10 can thereby be improved.

Describing a method of manufacturing the electronic component 10, the first and second coils 1, 2 and the first to fifth terminals 8*a* to 8*e* patterned and formed as described above are laminated and formed on the respective layers of the insulator 5 on the magnetic layer 6. Subsequently, the capacitor 3 and the respective layers of the insulator 5 are laminated and formed thereon.

Holes are then made from the lower surface (bottom surface) of the magnetic layer 6 toward the first to fifth terminals 8*a* to 8*e* by using blasting, laser, etc. The side surfaces of the holes are formed into a tapered shape and expanded on the lower surface side of the magnetic layer 6.

Subsequently, the second to fifth external terminals 4*b* to 4*e* are embedded into the holes corresponding to the first to fourth terminals 8*a* to 8*d* by screen printing etc. The nonmagnetic layer 7 is formed on the side surface of the hole corresponding to the fifth terminal 8*e* by printing etc., and the first external terminal 4*a* is embedded into the center of the nonmagnetic layer 7. The first to fifth external terminals 4*a* to 4*e* may be formed along the side surfaces of the holes by using plating etc.

(Second Embodiment)

Figure 6:
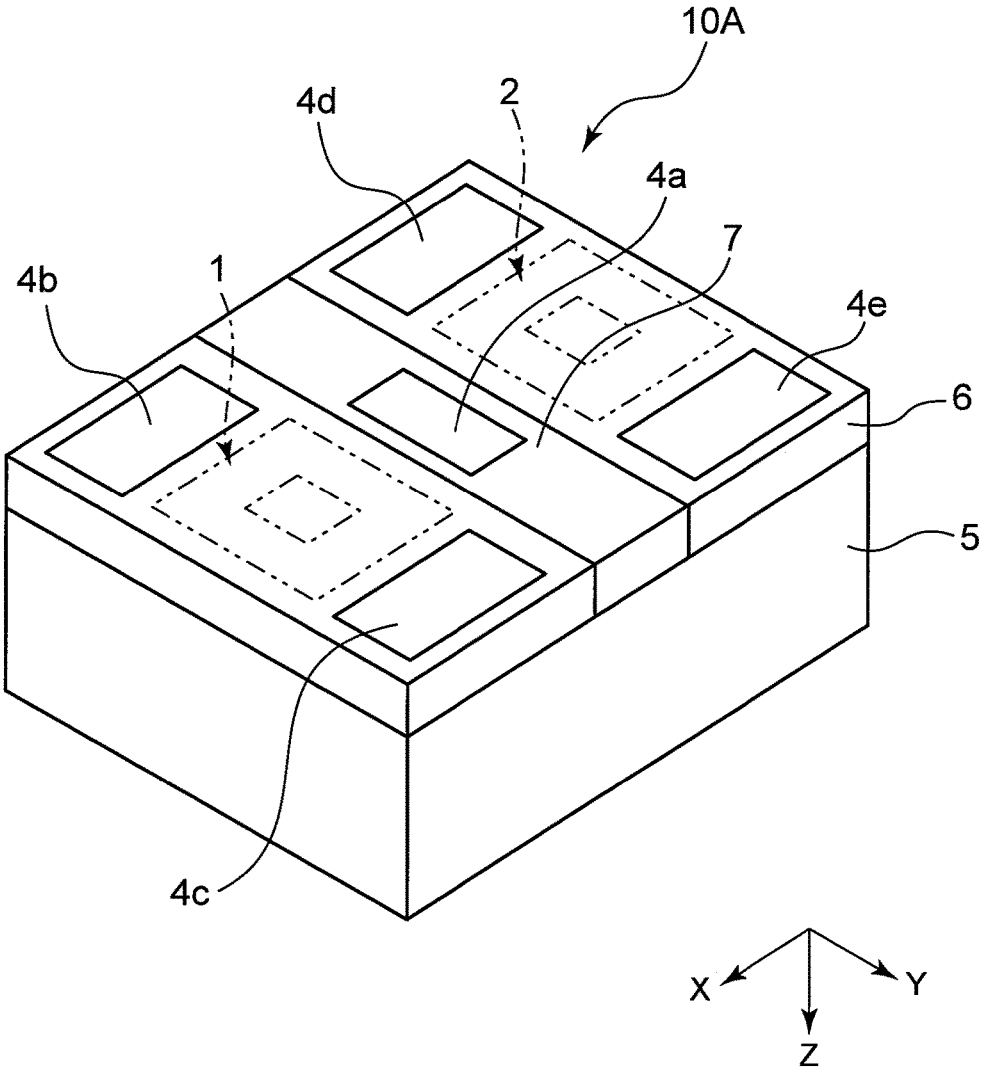
FIG. 6 is a perspective view of a second embodiment of the electronic component viewed from the bottom surface side.

FIG. 6 is a perspective view of a second embodiment of the electronic component of the present disclosure viewed from the bottom surface. The second embodiment is different from the first embodiment in the configuration of the nonmagnetic layer. This different configuration will hereinafter be described.

As shown in FIG. 6, an electronic component 10A has the nonmagnetic layer 7 disposed in the magnetic layer 6 such that the two first and second coils 1, 2 (the first to fourth spiral wirings 11 to 14, 21 to 24) are divided from each other when viewed from the one surface side of the magnetic layer 6. The nonmagnetic layer 7 extends from one end surface to the other end surface of the magnetic layer 6 in the Y direction. As is the case with the first embodiment, the nonmagnetic layer 7 surrounds the entire circumference of the first external terminal 4*a*.

In this case, for a method of forming the nonmagnetic layer 7, a concave groove is formed to extend from the one end surface to the other end surface of the magnetic layer 6 in the Y direction by using a dicer etc. Subsequently, the nonmagnetic layer 7 is embedded in the concave groove. A hole is made at a center portion of the nonmagnetic layer 7 by using a laser etc., and the first external terminal 4*a* is embedded in this hole.

Therefore, since the nonmagnetic layer 7 is disposed between the two first and second coils 1, 2 such that the two coils 1, 2 are divided from each other, the nonmagnetic layer 7 can divide a magnetic path between the two first and second coils 1, 2 and can improve isolation of each LC filter.

The present disclosure is not limited to the embodiments described above and may be changed in design without departing from the spirit of the present disclosure. For example, respective feature points of the first and second embodiments may variously be combined.

Although the coils and the capacitor are provided in the embodiments, a resistor, another coil, etc. may be provided instead of the capacitor. Alternatively, only the coils may be provided without providing the capacitor.

Although the nonmagnetic layer surrounds the entire outer circumference of the first external terminal in the embodiments, the nonmagnetic layer may surround at least a portion of the outer circumference of the first external terminal and, in this case, a plurality of nonmagnetic layers may intermittently be provided along the circumference of the first external terminal.

Although the nonmagnetic layer is in contact with the first external terminal in the embodiments, the nonmagnetic layer may be separated from the first external terminal without being in contact. Although the nonmagnetic layer is embedded to penetrate the magnetic layer from the one surface side to the other surface side, the nonmagnetic layer may be embedded only in a portion of the magnetic layer.

Although two coils are provided in the embodiments, one or three or more coils may be provided.

Although one coil is made up of four layers of spiral wirings in the embodiments, the number of spiral wirings may be increased or decreased. The coils may have a helical configuration rather than a spiral configuration.

Although the first external terminal connected to the ground is surrounded by the nonmagnetic layer in the embodiments, the second and fourth external terminals acting as input terminals or the third and fifth external terminals acting as output terminals may be surrounded by the nonmagnetic layer. In this case, the inductance can be adjusted by reducing the magnetic loss. Additionally, the direct current superposition characteristics can be improved.

Although the first to fifth external terminals are embedded in the magnetic layer and the nonmagnetic layer in the embodiments, a film-like conductor layer may further be formed by coating, plating, a thin-film method, etc., on the embedded portions partially exposed from the magnetic layer.

The invention claimed is:

1. An electronic component comprising:

an electric element including a coil;

a magnetic layer covering at least a portion of the electric element;

a plurality of external terminals electrically connected to the electric element and embedded in the magnetic layer to be partially exposed from one surface of the magnetic layer; and a nonmagnetic layer embedded in the magnetic layer, the plurality of external terminals including at least one or more first external terminals, the first external terminals being surrounded by the nonmagnetic layer when viewed from the one surface side of the magnetic layer, and the nonmagnetic layer surrounds the entire outer circumference of the first external terminal in an exposed region when viewed from the one surface side of the magnetic layer.

2. The electronic component according to claim 1, wherein the nonmagnetic layer is in contact with the first external terminals.

3. The electronic component according to claim 1, wherein the nonmagnetic layer is embedded to penetrate the magnetic layer from the one surface side to the other side opposite thereto.

4. The electronic component according to claim 1, wherein the electric element includes a capacitor, and wherein the first external terminals are connected to the capacitor.

5. The electronic component according to claim 4, wherein the first external terminals connected to the capacitor are connected to ground.

6. The electronic component according to claim 1, further comprising an insulator that is made up of a plurality of insulating layers laminated on the other surface on the side opposite to the one surface of the magnetic layer and that has the electric element embedded therein, wherein the coil includes conductor layers wound on the insulating layers.

7. The electronic component according to claim 6, wherein when viewed from the one surface side of the magnetic layer, two of the conductor layers are wound on the same one of the insulating layers, and the nonmagnetic layer is disposed to divide the two conductor layers from each other.

8. An electronic component comprising:

an electric element including a coil;

a magnetic layer covering at least a portion of the electric element;

a plurality of external terminals electrically connected to the electric element and embedded in the magnetic layer to be partially exposed from one surface of the magnetic layer;

a nonmagnetic layer embedded in the magnetic layer; and an insulator that is made up of a plurality of insulating layers laminated on the other surface on the side opposite to the one surface of the magnetic layer and that has the electric element embedded therein, the plurality of external terminals including at least one or more first external terminals, the first external terminals being surrounded by the nonmagnetic layer when viewed from the one surface side of the magnetic layer, the coil including conductor layers wound on the insulating layers, and when viewed from the one surface side of the magnetic layer, two of the conductor layers are wound on the same one of the insulating layers, and the nonmagnetic layer is disposed to divide the two conductor layers from each other.

* * * * *